US007601104B2

(12) United States Patent
Agrawal et al.

(10) Patent No.: US 7,601,104 B2
(45) **Date of Patent: *Oct. 13, 2009**

(54) PASSIVE GRAVITY-BALANCED ASSISTIVE DEVICE FOR SIT-TO-STAND TASKS

(75) Inventors: Sunil Agrawal, Newark, DE (US); Abbas Fattah, Newark, DE (US); Glenn Catlin, Bloomfield, NJ (US); John Hamnett, Natick, MA (US)

(73) Assignee: University of Delaware, Newark, DE (US)

( * ) Notice: Subject to any disclaimer, the term of this patent is extended or adjusted under 35 U.S.C. 154(b) by 614 days.

This patent is subject to a terminal disclaimer.

(21) Appl. No.: 11/409,163

(22) Filed: Apr. 21, 2006

(65) Prior Publication Data

US 2006/0260621 A1 Nov. 23, 2006

Related U.S. Application Data

(63) Continuation-in-part of application No. 11/113,729, filed on Apr. 25, 2005, now Pat. No. 7,544,155.

(60) Provisional application No. 60/748,429, filed on Dec. 8, 2005.

(51) Int. Cl.
*A61H 3/00* (2006.01)
*A61H 5/00* (2006.01)

(52) U.S. Cl. ..... 482/69; 601/34

(58) Field of Classification Search ..... 482/51, 482/54, 66–69; 434/255; 601/23, 33, 35; 602/26, 23; 297/DIG. 10
See application file for complete search history.

(56) References Cited

U.S. PATENT DOCUMENTS 2,210,269 A * 8/1940 Taylor ..... 601/33
5,020,790 A * 6/1991 Beard et al. ..... 482/4
5,333,604 A * 8/1994 Green et al. ..... 601/33
6,213,554 B1 * 4/2001 Marcoux et al. ..... 297/330
6,821,233 B1 * 11/2004 Colombo et al. ..... 482/54
7,247,128 B2 * 7/2007 Oga ..... 482/51
2003/0023195 A1 1/2003 Rahman et al.
2005/0043661 A1 2/2005 Nashner

FOREIGN PATENT DOCUMENTS

GB 1 406 420 A 9/1975
WO WO 94/09727 A 5/1994
WO WO 00/28927 A 5/2000

OTHER PUBLICATIONS

Sunil K. Agrawal, Abbas Fattah, Sai Banala; "Design and Prototype of a Gravity-Balanced Leg Orthosis"; International Journal of HWRS; vol. 4, No. 3, Sep. 2003; pp. 13-16.

Sunil K. Agrawal, Abbas Fattah; "Design of an Orthotic Device for Full or Partial Gravity-Balancing of a Human Upper Arm During Motion"; Proceedings of the 2003 IEEE/RSJ International Conference on Intelligent Robots and Systems; Oct. 2003; pp. 2841-2846.

Sai K. Banala, Sunil K. Agrawal, Abbas Fattah, Katherine Rudolph, John P. Scholz; A Gravity Balancing Leg Orthosis for Robotic Rehabilitation; Proceedings of the 2004 IEEE International Conference on Robotics & Automation; Apr. 2004; pp. 2474-2479.

U.S. Appl. No. 11/113,729 of Sunil K. Agrawal et al. filed Apr. 25, 2005.

(Continued)

*Primary Examiner*—Fenn C Mathew
(74) *Attorney, Agent, or Firm*—RatnerPrestia

(57) ABSTRACT

A passive gravity balancing assist device for human sit-to-stand motion is provided. The design combines the use of auxiliary parallelograms with springs to produce an orthotic device wherein the total potential energy of the system is constant during standing and sitting motion.

10 Claims, 5 Drawing Sheets

OTHER PUBLICATIONS

Abbas Fattah, et al.; "Design of a Passive Gravity-Balanced Assistive Device for Sit-to-Stand Tasks"; Journal of Mechanical Design, in press (to appear Sep. 2006).

Abbas Fattah, Ph.D. et al.; "Design of a Gravity-Balanced Assistive Device for Sit-to-Stand Tasks" ASME Journal; Proceedings of DETC '04 ASME 2004 Design Engineering Technical Conferences Sep. 28-Oct. 2, 2004; Salt Lake City, Utah, USA; pp. 1-7.

Roman Kamnik, et al.; "Robot Assistive Device for Augmenting Standing-Up Capabilities in Impaired People"; journal; Oct. 2003; pp. 3606-3611; Proceedings of the 2003 IEEE/RSJ International Conference on Intelligent Robots and Systems, Las Vegas, NV; USA.

Michael Peshkin, et al.; "A Robotic Overground Gait and Balance Training Device"; Proceedings of the 2005 IEEE 9$^{th}$ International Conference on Rehabilitation Roboticss; 2005; pp. 241-246; Chicago PT LLC, Evanston, IL; USA.

Roman Kamnik et al.; "Rehabilitation Robot Cell for Multimodal Standing-Up Motion Augmentation"; article; Apr. 2005; pp. 2289-2294; Proceedings of the 2005 IEEE International Conference on Robotics and Automation; Barcelona, Spain; Spain.

T. Bajd et al.; "Standing-Up of a Healthy Subject and a Paraplegic Patient"; article; 1982; pp. 1-10; vol. 15, No. 1; J. Biomechanics, Great Britain.

N de N Donaldson et al.; "FES Standing: Control by Handle Reactions of Leg Muscle Stimulation" (CHRELMS); Dec. 1996; pp. 280-284; vol. 4, No. 4; IEEE Transactions on Rehabilitation Engineering; New York, NY; USA.

* cited by examiner

PASSIVE GRAVITY-BALANCED ASSISTIVE DEVICE FOR SIT-TO-STAND TASKS

RELATED APPLICATIONS

This application is a continuation-in-part of U.S. Ser. No. 11/113,729 and claims benefit of priority from U.S. Ser. No. 11/113,729, filed Apr. 25, 2005, now U.S. Pat. No. 7,544,155, and U.S. 60/748,429, filed Dec. 8, 2005, the contents of which are incorporated herein by reference.

STATEMENT REGARDING FEDERALLY SPONSORED RESEARCH

The work leading to this invention was financed in part by the National Institute of Health (NIH) under a grant NO. 1 RO1 HD38582-01A2.

FIELD OF THE INVENTION

This invention relates to rehabilitative assistive devices. More specifically, this invention provides a method and associated passive gravity-balanced apparatus for facilitating movement by persons suffering from muscle weakness or impaired motor control.

BACKGROUND OF THE INVENTION

A vast number of people are affected by conditions that result in profound muscle weakness or impaired motor control. For example, people with severe muscle weakness from neurological injury, such as hemiparesis from stroke, often have substantial movement limitations, and for many people, sit-to-stand motion becomes increasingly difficult with age.

One of the aims of rehabilitation after stroke is to improve the walking function. However, equipment available to facilitate this is severely limited. Several lower extremity rehabilitation machines have been developed recently to help retrain gait during walking. Lokomat® is an actively powered exoskeleton, designed for persons with spinal cord injury. The persons use this machine while walking on a treadmill. Mechanized Gait Trainer® (MGT) is a single degree of freedom powered machine that drives the leg to move in a prescribed gait pattern. The machine consists of a foot plate connected to a crank and rocker system. The device simulates the phases of gait, supports the subjects according to their abilities, and controls the center of mass in the vertical and horizontal directions. Auto-Ambulator® is a rehabilitation machine for assisting individuals, with stroke and spinal cord injuries, in leg motion impairments. This machine is designed to replicate the pattern of normal gait.

Sit-to-stand (STS) is one of the most common daily activities. It is a pre-requisite for other functional movements that require ambulation and is mechanically demanding. In the United States, an estimated two million people over age 64 have difficulty in rising from a chair. Functional electrical stimulation (FES) of muscles has been used to assist disabled individuals with STS motion, in particular to assist a paraplegic person to stand from a wheelchair. Handle reactions have also been used as a measure of stimulation of leg muscles during standing up. Powered robotic assistive devices that may incorporate FES have also been designed for standing-up training. KineAssist is a robotic device for gait and balance training. It is a microprocessor controlled, motor actuated device that provides partial body weight support and postural torques on the torso.

The use of these gait-training and sit-to-stand machines is limited in that they require external power to function, posing increased risk to the user, and require supervisory staff for safe use. Additionally, they only move persons through predetermined movement patterns rather than allowing them to move under their own control. The failure to allow persons to experience and practice appropriate movement prevents necessary changes in the nervous system to promote relearning of typical patterns. There is, therefore, a need for a rehabilitation device that provides passive assistance, supports a person according to his/her abilities and allows the person to move using his/her own muscle power.

Gravity balancing is often used in industrial machines to decrease the required actuator efforts during motion, but has rarely been used for assistive rehabilitation devices. A machine is said to be gravity balanced if joint actuator torques are not needed to keep the system in equilibrium in any configuration. Gravity balancing is a useful principle that can assist a user in walking and in STS activity. In STS motion the required joint torques are due to gravity, passive muscle forces, and inertia. Because STS movement is relatively slow, the joint torque due to gravity is the most dominant. A gravity-balancing apparatus does not require power and keeps the human body in neutral equilibrium during the entire range of motion, reducing the amount of effort needed for the motion. A gravity-balancing apparatus may be used as a functional rehabilitative aid, a training device, or an evaluation tool for the study of specific types of motion.

SUMMARY OF THE INVENTION

There is provided according to this invention equipment that allows persons to use their impaired muscles to move their limbs under their own power by balancing the effects of gravity on the afflicted limbs thereby reducing the effort needed to use such limb(s). Such balancing is achieved by transferring the weight of the afflicted limbs to a support external to the limbs, such as, for example a harness worn by the person or a supporting structure forming part of a complete training system.

In its broader aspects the invention encompasses a method and an apparatus for assisting a person to move from a seated to a standing position, comprising an articulated passive gravity balanced assistive device for assisting a person to move from a first seated position to a second standing position, said person having an ankle, a calf, a thigh and a torso, the device comprising a fixed primary supporting point; a first member adapted to be attached to said calf having a first and a second end, a second member pivotally connected at one end thereof to said first member second end and adapted to be attached to said thigh, and a third member pivotally connected to another end of said second member and adapted to be attached to said torso, said members each comprising a scale length attachment point; a parallelogram structure connecting said scale length attachment points on each of said first, second and third members to a combined center of mass of said plurality of pivotally connected members and said calf, thigh and torso attached thereto, said parallelogram structure comprising first, second and third parallelograms interconnecting said scale attachment points on said first second and third members and said combined center of mass, each comprising a spring extending between opposite corners thereof, and a supporting spring extending between said center of mass and said primary supporting point; wherein said springs are selected such that the total potential energy of the articulated system is invariant with member configuration.

There is also provided according to this invention, a method for assisting a person to move from a first seated position to a second standing position comprising transferring a weight supported on a pivoting support on a first supporting structure to a primary support, said weight comprising a weight of at least three interconnected articulated members pivotally attached to said pivoting support, each of said articulated members removably attached to said person's calf, thigh and torso respectively, the method comprising:

I. identifying a center of mass for each of the articulated members, together with any additional weight attached to such articulated members;

II. calculating a scale length for each of the articulated members;

III. deriving a parallelogram structure connecting attachment points determined by said scale length on each of said first, second and third members to a combined center of mass of said plurality of pivotally connected members and said calf, thigh and torso attached thereto, said parallelogram structure comprising first, second and third parallelograms interconnecting said attachment points on said first second and third members and said combined center of mass, each comprising a spring extending between opposite corners thereof, and a supporting spring extending between said center of mass and said primary supporting point;

IV. connecting said parallelogram structure to said three members;

V. selecting springs to connect the combined center of mass to said primary supporting point and to said plurality of articulated members such that the total potential energy of the system is invariant with member configuration; and VI. connecting the combined center of mass:

(a) to the primary support with at least one of said selected springs; and (b) to the articulated members with at least another of said selected springs.

DETAILED DESCRIPTION OF THE INVENTION

Although the invention is illustrated and described herein with reference to specific embodiments, the invention is not intended to be limited to the details shown. Rather, various modifications may be made in the details within the scope and range of equivalents of the claims and without departing from the invention. The figures and drawings are not to scale and only include those elements that are necessary in describing and explaining the invention. Such figures are not intended to replace complete engineering drawings.

Gravity balancing, according to this invention, is achieved by fixing a center of mass (COM) of combined articulated members and supported weight of the body in space using a parallelogram mechanism, and then making the total potential energy for any configuration of the articulated members of the system constant using springs. The principle involved in removing the weight of the leg, for example, is to support the weight of the leg using articulated members attached to the thigh and calf and place springs at suitable mathematically calculated positions on the articulated members such that they completely balance the effect of gravity of both the leg and members.

A gravity-balanced assistive device for the human body may be designed by (i) determining the combined COM of the articulated supporting members and attached parts of the human body using auxiliary parallelograms; and (ii) selecting springs to connect the articulated members to the COM such that the total potential energy of the system is invariant with configuration.

In one embodiment, the device is an orthosis device with straps or other convenient attachments between the corresponding moving segments of the device and the person's leg. In this embodiment, the following assumptions are made:

(i) the motion of the body is in the sagittal plane;

(ii) both legs have the same motion during the STS motion;

(iii) the device links are lightweight and do not add significant mass to the moving limbs; and (iv) the COM of each link lies on the line connecting the two joints.

Figure 1:
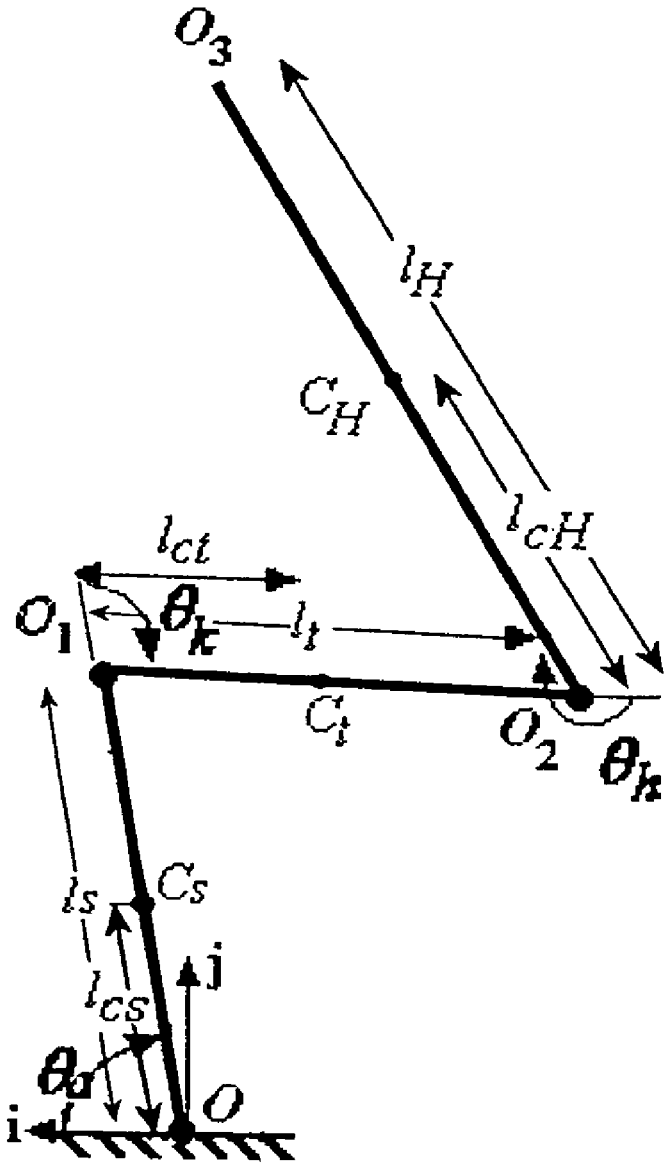
FIG. 1 is a three degrees of freedom planar model of the human body.

The human body can be modeled during sit-to-stand (STS) motion as having three degrees-of-freedom (DOF) in the sagittal plane at the hip, knee, and ankle, as shown in FIG. 1. The sagittal plane approximation holds if both legs do not have any out-of-plane motion. Links $l_s(00_1)$, $l_t(0_10_2)$, and $l_H(0_20_3)$ represent the shank (calf and ankle), thigh, and HAT (Head, Arm and Torso) segments of the human body, respectively. The head, arm and torso of the body is considered as a "HAT" body whose center of mass $C_H$ remains fixed within itself during STS motion. $C_j$ represents the center of mass of supporting member j, $l_j$ is the length of supporting member j, and $l_{cj}$ is a distance to the center of mass of supporting member j from an origin. The origin may be a pivot point. (The subscript j stands for any of the subscripts s, t, or H, thorougout.) The angles $\theta_a$, $\theta_k$ and $\theta_h$ are the ankle, knee and hip joint angles, respectively.

Figure 2:
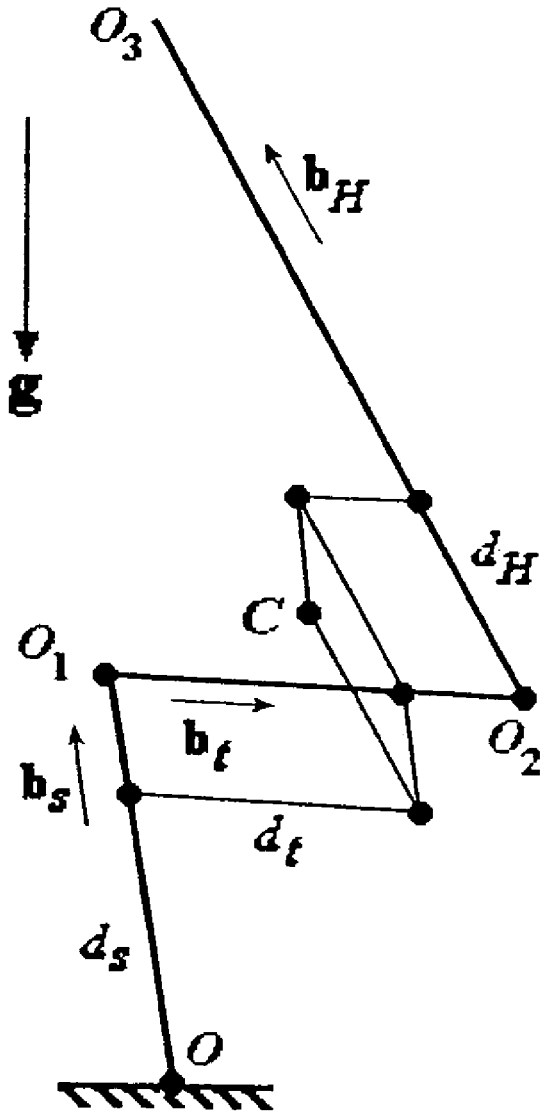
FIG. 2 is a model of the three degrees of freedom human body and device with auxiliary parallelograms to determine the center of mass of the body.

To form parallelograms, scaled lengths $d_s$, $d_t$, and $d_H$ in each of the articulated members are determined. Scaled lengths $d_j$ are determined by geometry and mass distribution. The three scaled lengths are used to form three parallelograms and associated scale length attachment points and to identify the location of the COM C ($r_{OC}=d_sb_s+d_tb_t+d_Hb_H$) are shown in FIG. 2, where:

$$d_s=(1/M)\ (m_tl_s+m_Hl_s+m_sl_{cs})$$

$$d_t=(1/M)\ (m_Hl_t+m_tl_{ct})$$

$$d_H=(1/M)\ m_Hl_{cH}$$

and where:

$$M=m_s+m_t+m_H$$

Figure 3:
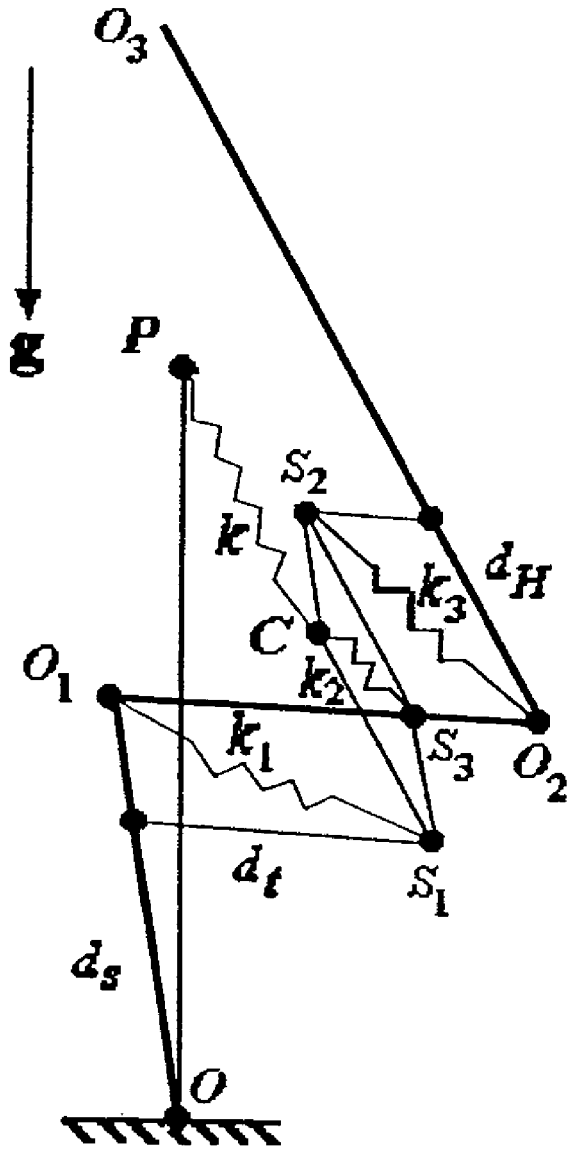
FIG. 3 is a schematic of a first embodiment of an STS device, including the placement of spring attachments for the three degrees of freedom human body.

$m_j$=mass of a length j of the combined supporting member with attached weight, $b_j$=unit vector along member $l_j$ and g=gravitational acceleration Having determined the COM of the system, the spring constants are next determined. FIG. 3 illustrates, schematically, a first embodiment, of a STS device. The human body and the device is gravity-balanced by attaching four springs to the system, one across each of the three parallelograms and one from the COM to the fixed primary supporting point P as shown in FIG. 3. The total potential energy of the system consists of gravitational ($V_g$) and elastic ($V_s$) energies due to the springs. Its expression is given by:

$$V=V_s+V_g=(½)kx^2+(½)k_1x_1^2+(½)k_2x_2^2+(½)k_3x_3^2-Mg\circ r_{oc}.$$

Upon substitution of $$x^2=\|PC\|\cdot\|PC\|,$$

$$x_1^2=\|O_1S_1\|\cdot\|O_1S_1\|,$$

$$x_2^2=\|CS_3\|\cdot\|CS_3\| \text{ and}$$

$$x_3^2=\|O_2S_2\|\cdot\|O_2S_2\|$$

and expanding the results thus obtained in terms of joint angles, one obtains:

$$-Mg\circ r_{oc}=Mg(d_ss_a+d_ts_{ak}+d_HS_{akh})$$

$$x^2=(d_sc_a+d_tc_{ak}+d_Hc_{akh})^2+(d_ss_a+d_ts_{ak}+d_Hs_{akh}-d)^2$$

$$x_1^2=d_t^2+(l_s-d_s)^2-2(l_s-d_s)d_tc_k$$

$$x_2^2=d_H^2+(l_s-d_s)^2-2d_H(l_s-d_s)c_{kh}$$

$$x_3^2=(l_t-d_t)^2+d_H^2-2d_H(l_t-d_t)c_h.$$

Here, $c_i$, $s_i$, $c_{ij}$, $s_{ij}$, $c_{ijk}$ and $s_{ijk}$ stand for cos $\theta_i$, sin $\theta_i$, cos $(\theta_i+\theta_j)$, sin $(\theta_i+\theta_j)$, COS $(\theta_i+\theta_j+\theta_k)$ and sin $(\theta_i+\theta_j+\theta_k)$, respectively. Also, d=‖OP‖ is the distance along the gravity vector between point O and the fixed primary support point P as shown in FIG. 3, and x and $x_i$ are deformation and k and $k_i$ are stiffness constants of the springs, where i=1, 2, 3. In this above analysis, it is assumed that the undeformed length of each spring is zero. In actual practice, this can achieved with a combination of a spring, cable, and pulley, as described in co-pending U.S. patent application Ser. No. 11/113,729.

Setting next the coefficients of the configuration variables in the potential energy to zero, the desired stiffness of the springs for gravity balancing of the system are derived as:

$$k=Mg/d$$

$$k_1=kd_s/(l_s-d_s)$$

$$k_2=kd_s/(l_s-d_s)$$

$$k_3=kd_t/(l_t-d_t).$$

Figure 4:
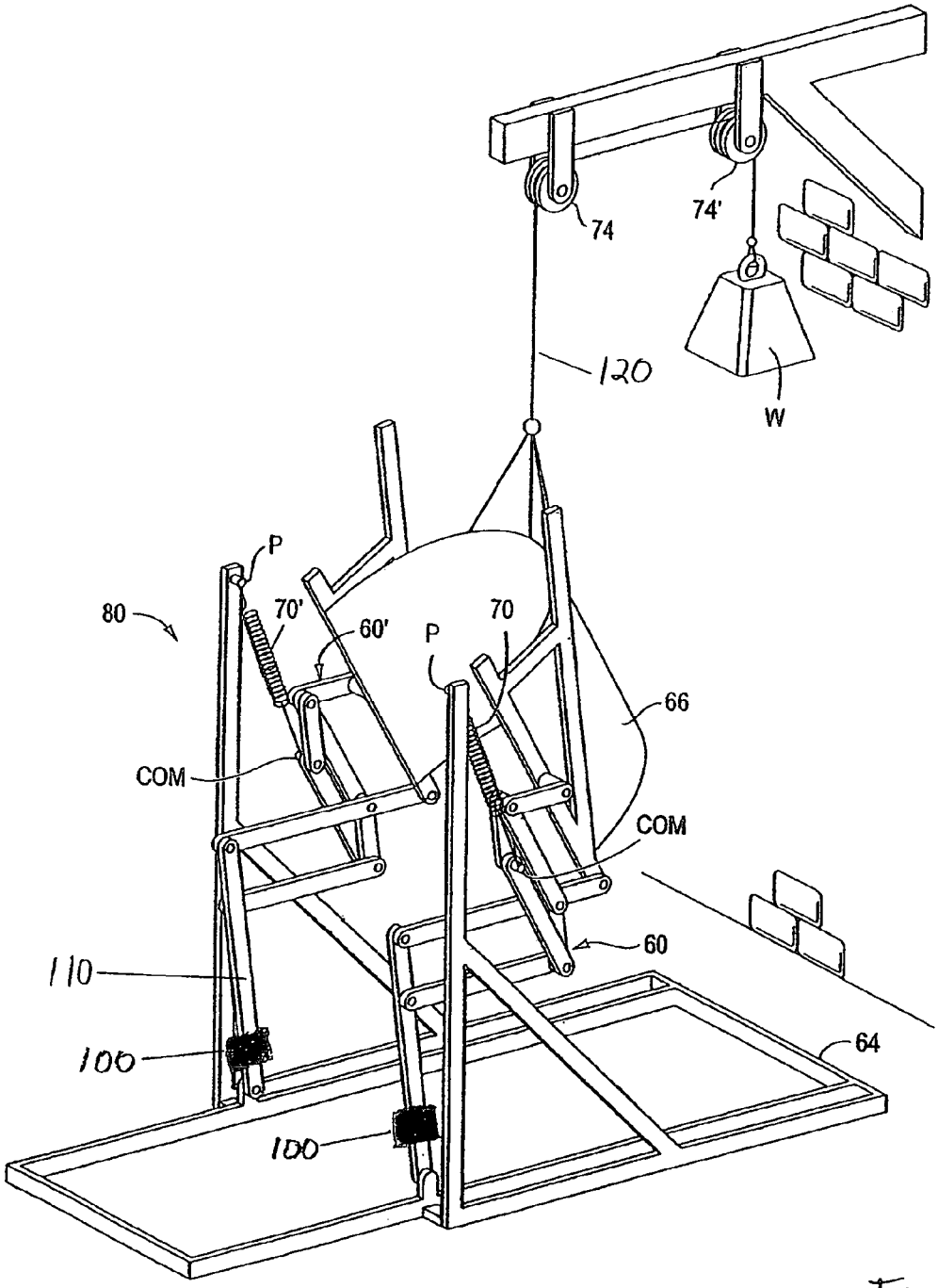
FIG. 4 is a schematic model of a second embodiment of the STS device.

FIG. 4 shows a schematic representation of an apparatus (80) according to a second embodiment of this invention, which allows the use of springs with smaller stiffness constants The apparatus comprises two sets of articulated members 60 and 60', each set forming three parallelograms on the left and right sides, corresponding to the three parallelograms in FIG. 3. The system of articulated support members serves as an exoskeleton and is mounted on a frame 64. The frame and the members may be fabricated out of a material with relatively low density and high intrinsic stiffness in order to reduce the weight of the device and provide for its easy adjustment. Exemplary materials include extruded aluminum, titanium, carbon reinforced fibers, Kevlar reinforced fibers, and reinforced glass fibers.

The length of each articulated member may be adjusted and optimized for the user, using, for example, telescoping members. The primary springs 70 and 70' connect the centers of mass COM to the frame at the fixed primary supporting points P. The auxiliary springs within the parallelograms have been omitted for clarity; their location and points of attachment are as illustrated in FIG. 3.

The embodiment of FIG. 4 allows the use of springs with reduced stiffness and also parallelograms of larger size than in the embodiment of FIG. 3. This is achieved either by:

a) attaching ankle weights 100 to shift the position of the center of mass of the shank member 110, or b) countering the weight of the human body using a harness 66 strapped to the torso by any appropriate means and attached to a counterweight W with a cable 120 running over pulleys 74 and 74'. The cable 120 is attached to the harness 66 at the COM of the HAT member (see FIGS. 2 and 3), or c) a combination of the two.

As an alternative to ankle weights 100, other sources of resistance, or opposing force, may be used, such as springs.

As a specific numerical example, if each ankle weight 100 is 3 kg and counterweight W is 23 kg, calculated spring constants are:

$$k=0.34\ kN/m$$

$$k_1=1.91\ kN/m$$

$$k_2=1.91\ kN/m$$

$$k_3=0.6\ kN/m$$

In this embodiment, calculated required forces exerted by the springs are reduced from those of the first embodiment; by a factor of about 5 for spring $k_3$ up to a factor of about 12 for spring $k_2$.

Figure 5:
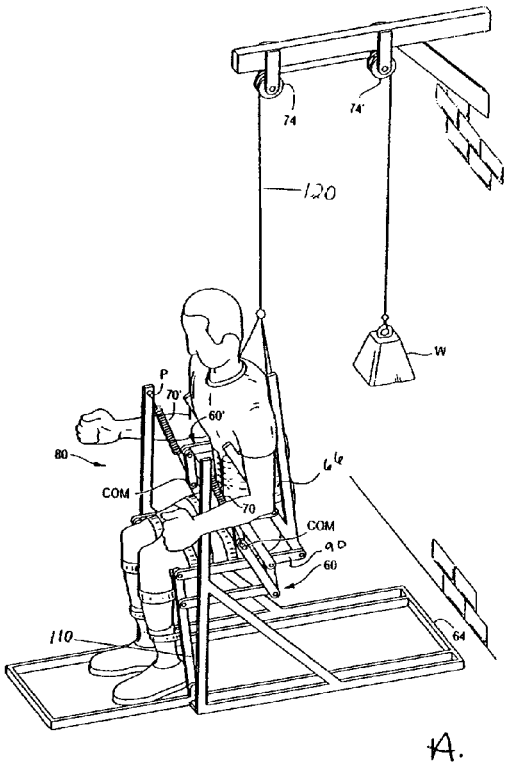
FIGS. 5A and 5B show a person using the apparatus of FIG. 4 in (a) sitting and (b) standing position.
Figure 5:
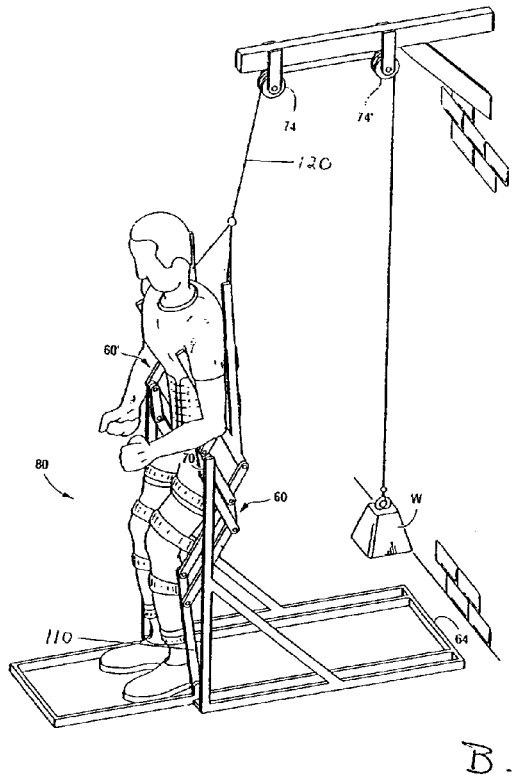

FIGS. 5A and 5B illustrate the use of an STS assist device by a human being. The device is utilized by a person by attaching articulated members 90 and 110 to the person's thigh and calf, respectively, and the harness 66 to the torso, as described above. After the apparatus is attached, the user's weight is counterbalanced by the device and the user may practice standing up (FIG. 5*b*) and sitting down (FIG. 5*a*) a number of times to train and strengthen the required nerves and muscles.

Although the invention is illustrated and described herein with reference to specific embodiments, the invention is not intended to be limited to the details shown. Rather, various modifications may be made in the details within the scope and range of equivalents of the claims and without departing from the invention.

What is claimed is:

1. An apparatus comprising a plurality of pivotally connected members forming an articulated system for attaching to a person and passively assisting said person to move from a first seated position to a second standing position and vice versa by transferring the combined weight of the articulated system and said person from said person's legs to a primary support, the apparatus comprising:

a parallelogram structure connecting a scale length attachment point on each of said plurality of pivotally connected members to a combined center of mass of said plurality of pivotally connected members;

a first connecting spring connecting said center of mass to said primary support, and a second connecting spring connecting said center of mass to said plurality of pivotally connected members, wherein said first and second springs are selected such that the total potential energy of the articulated system is invariant with member configuration; and wherein the articulated system comprises three degrees of freedom and is adapted for mounting on a person forming an exoskeleton having pivoting members attached to a person's torso, thigh, and calf and wherein said first supporting point is said person's ankle and said primary point is located external to said exoskeleton.

2. The apparatus according to claim 1 comprising three pivotally connected members and three parallelogram structures, each connecting a scale length attachment point on each of said pivotally connected members to said combined center of mass.

3. The apparatus according to claim 2 further comprising a third and a fourth connecting springs said second, third and fourth connecting springs connecting said center of mass, the knee joint and the hip joint to said scale length attachment point on each of said three pivotally connected members.

4. An articulated passive gravity balancing assistive device for assisting a person to move from a first seated position to a second standing position and vice versa, said person having an ankle, a calf, a thigh and a torso, the device comprising:

a fixed primary supporting point;

a first member adapted to be attached to said calf having a first and a second end, a second member pivotally connected at one end thereof to said first member second end and adapted to be attached to said thigh, and a third member pivotally connected to another end of said second member and adapted to be attached to said torso, said members each comprising a scale length attachment point;

a parallelogram structure connecting said scale length attachment points on each of said first, second and third members to a combined center of mass of said plurality of pivotally connected members and said calf, thigh and torso attached thereto, said parallelogram structure comprising first, second and third parallelograms interconnecting said scale length attachment points on said first second and third members and said combined center of mass, each parallelogram comprising a spring extending between opposite corners thereof, and a supporting spring extending between said center of mass and said primary supporting point;

wherein said springs are selected such that the total potential energy of the articulated system is invariant with member configuration.

5. The device according to claim 4 wherein the combined center of mass is located at a distance $r_{oc}$ from said first end of said first member, and wherein:

$$r_{oc}=d_s b_s+d_t b_t+d_H b_H$$

where $b_j$ is the unit vector along member $l_j$ and $m_s$, $m_t$ and $m_H$ are the masses of the calf, thigh and HAT (Head Arms and Torso)

$$d_s=(1/M)*(m_t l_s+m_H l_s+m_s l_{cs})$$

$$d_t=(1/M)*(m_H l_t+m_t l_{ct})$$

$$d_H=(1/M)*(m_H l_{cH})$$

and $$M=m_s+m_t+m_H.$$

6. The device according to claim 4 wherein said parallelogram structure comprises a first parallelogram comprising portions of said first and said second members and connecting said scale length attachment point of said first member to said scale length attachment point of said second member having one corner at said first end of said second member, and a first spring extending between said first end and an opposite corner of said first parallelogram;

a second parallelogram comprising portions of said second and said third members and connecting said scale length attachment point of said second member to said scale length attachment point of said third member having one corner at said second end of said second member, and a second spring extending between said second end and an opposite corner of said second parallelogram;

a third parallelogram connecting said combined center of mass of said first second and third members and said calf, thigh and torso connected thereon, said third parallelogram connecting said opposite corner of said first parallelogram, said scale length attachment point of said second member said opposite corner of said second parallelogram and said combined center of mass, said third parallelogram further comprising a third spring extending between said center of mass and said scale length attachment point on said second member; and a fourth spring connecting said combined center of mass to said primary supporting point.

7. The device according to claim 5 wherein said parallelogram structure comprises a first parallelogram comprising portions of said first and said second members and connecting said scale length attachment point of said first member to said scale length attachment point of said second member having one corner at said first end of said second member, and a first spring extending between said first end and an opposite corner of said first parallelogram;

a second parallelogram comprising portions of said second and said third members and connecting said scale length attachment point of said second member to said scale length attachment point of said third member having one corner at said second end of said second member, and a second spring extending between said second end and an opposite corner of said second parallelogram;

a third parallelogram connecting said combined center of mass of said first second and third members and said calf, thigh and torso connected thereon, said third parallelogram connecting said opposite corner of said first parallelogram, said scale length attachment point of said second member said opposite corner of said second parallelogram and said combined center of mass, said third parallelogram further comprising a third spring extending between said center of mass and said scale length attachment point on said second member; and a fourth spring connecting said combined center of mass to said primary supporting point.

8. The device according to claim 5 further comprising a counterweight and pulley, the counterweight exerting a force on at least one of the first, second, or third members and opposing the force exerted by at least one of the springs extending between opposite corners of the parallelograms and the supporting spring.

9. The device according to claim 5 further comprising weights attached to the first member.

10. A method for assisting a person to move from a first seated position to a second standing position comprising transferring a weight supported on a pivoting support on a first supporting structure to a primary support, said weight comprising a weight of at least three interconnected articulated members pivotally attached to said pivoting support, each of said articulated members removably attached to said person's calf, thigh and torso respectively, the method comprising:

I. identifying a center of mass for each of the articulated members, together with any additional weight attached to such articulated members;

II. calculating a scale length for each of the articulated members;

III. deriving a parallelogram structure connecting attachment points determined by said scale length on each of said first, second and third members to a combined center of mass of said plurality of pivotally connected members and said calf, thigh and torso attached thereto, said parallelogram structure comprising first, second and third parallelograms interconnecting said attachment points on said first second and third members and said combined center of mass, each comprising a spring extending between opposite corners thereof, and a supporting spring extending between said center of mass and said primary supporting point;

IV. connecting said parallelogram structure to said three members;

V. selecting springs to connect the combined center of mass to said primary supporting point and to said plurality of articulated members such that the total potential energy of the system is invariant with member configuration; and VI. connecting the combined center of mass:

(a) to the primary support with at least one of said selected springs; and (b) to the articulated members with at least another of said selected springs.

* * * * *